US011045849B2

(12) United States Patent
Ohata

(10) Patent No.: US 11,045,849 B2
(45) Date of Patent: Jun. 29, 2021

(54) COMPOSITE CEMENTED CARBIDE ROLL

(71) Applicant: HITACHI METALS, LTD., Tokyo (JP)

(72) Inventor: Takumi Ohata, Kitakyusyu (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/756,985

(22) PCT Filed: Jan. 31, 2019

(86) PCT No.: PCT/JP2019/003326
§ 371 (c)(1),
(2) Date: Apr. 17, 2020

(87) PCT Pub. No.: WO2019/151379
PCT Pub. Date: Aug. 8, 2019

(65) Prior Publication Data

US 2021/0121925 A1 Apr. 29, 2021

(30) Foreign Application Priority Data

Jan. 31, 2018 (JP) ..... JP2018-015950

(51) Int. Cl.
*B21B 27/03* (2006.01)
*C22C 29/08* (2006.01)

(52) U.S. Cl.
CPC ..... *B21B 27/032* (2013.01); *C22C 29/08* (2013.01)

(58) Field of Classification Search
CPC ..... B21B 27/032; C22C 29/08
(Continued)

(56) References Cited

U.S. PATENT DOCUMENTS 3,976,482 A * 8/1976 Larson ..... C22C 1/04 419/23
3,993,446 A * 11/1976 Okawa ..... C22C 29/067 75/240

(Continued)

FOREIGN PATENT DOCUMENTS

JP 51-44502 A 4/1976
JP 60-83708 A 5/1985

(Continued)

OTHER PUBLICATIONS

English translation of WO 2015053137 A1 (Year: 2015).*

(Continued)

*Primary Examiner* — Jason L Vaughan
(74) *Attorney, Agent, or Firm* — Sughrue Mion, PLLC

(57) ABSTRACT

A composite cemented carbide roll comprising an inner layer made of steel, and intermediate and outer layers made of cemented carbide containing WC particles; the cemented carbide forming the outer layer comprising 55-90 parts by mass of WC particles, and 10-45 parts by mass of a binder phase having a particular composition comprising Fe as a main component; the cemented carbide forming the intermediate layer comprising 30-65 parts by mass of WC particles, and 35-70 parts by mass of a binder phase having a particular composition comprising Fe as a main component; and the amount c1 (parts by mass) of WC particles in the outer layer and the amount c2 (parts by mass) of WC particles in the intermediate layer meeting $0.45 \leq c2/c1 \leq 0.85$.

7 Claims, 3 Drawing Sheets

(58) Field of Classification Search
USPC ..... 492/58, 57
See application file for complete search history.

(56) References Cited

U.S. PATENT DOCUMENTS 4,000,010 A * 12/1976 Sekimoto ..... B21B 27/00 148/524
4,137,106 A * 1/1979 Doi ..... B21B 27/00 228/131
4,697,320 A * 10/1987 Ishihara ..... C23C 4/06 241/228
4,941,251 A * 7/1990 Sobue ..... B21B 27/03 492/3
5,081,760 A * 1/1992 Kikuhara ..... B32B 15/011 492/3
5,368,628 A * 11/1994 Friederichs ..... B23P 15/40 75/230
5,418,049 A * 5/1995 Drougge ..... C22C 29/08 407/119
5,441,693 A * 8/1995 Ederyd ..... B01J 3/065 419/10
5,813,962 A * 9/1998 Kanayama ..... B21B 27/00 492/54
5,902,942 A * 5/1999 Maderud ..... C22C 29/08 75/240
6,086,650 A * 7/2000 Carpenter ..... C22C 29/08 75/240
6,258,147 B1 7/2001 Jansson et al.
6,299,658 B1 * 10/2001 Moriguchi ..... C22C 29/02 51/307
6,374,494 B1 * 4/2002 Sonobe ..... B21B 27/00 29/895.3
2006/0035082 A1 * 2/2006 Hattori ..... B21B 27/032 428/408
2010/0292061 A1 * 11/2010 Sontgen ..... C25D 15/00 492/9

FOREIGN PATENT DOCUMENTS

JP 05-171339 A 7/1993
JP 105824 A 1/1998
JP 2000-219931 A 8/2000
JP 2002-301506 A 10/2002
JP 2003-342668 A 12/2003
JP 2004-167503 A 6/2004

OTHER PUBLICATIONS

International Search Report for PCT/JP2019/003326 dated Mar. 26, 2019 [PCT/ISA/210].
European Search Report dated Oct. 2, 2020 in European Patent Application No. 19 747 291.3.

* cited by examiner

COMPOSITE CEMENTED CARBIDE ROLL

CROSS REFERENCE TO RELATED APPLICATIONS

This application is a National Stage of International Application No. PCT/JP2019/003326 filed Jan. 31, 2019, claiming priority based on Japanese Patent Application No. 2018-015950 filed Jan. 31, 2018.

FIELD OF THE INVENTION

The present invention relates to a composite cemented carbide roll used for rolling strips, plates, wires, rods, etc. of steel, which comprises an outer layer of cemented carbide metallurgically bonded to an outer peripheral surface of an inner layer made of a material having excellent toughness.

BACKGROUND OF THE INVENTION

To meet the requests for higher quality such as improved dimensional accuracy, reduced surface defects, improved surface gloss, etc. of rolled steel, cemented carbide having excellent wear resistance, surface roughening resistance, etc. is used for rolls for rolling wires, rods, plates, etc. of steel. As is known, the cemented carbide is a sintered alloy of tungsten carbide (WC) bonded by a metal binder such as Co, Ni, Fe, etc., and some cemented carbides comprise carbides of Ti, Ta, Nb, etc. in addition to WC.

Because cemented carbide is expensive and difficult to be formed into large products, rolls having a structure in which metal shaft is inserted into a cemented carbide sleeve are disclosed. For example, JP S60-83708 A discloses a method for pressure-fixing a cemented carbide sleeve to a shaft comprising arranging a heat-expanded spacer having a thickness gradually increasing from the inner periphery to the outer periphery around the shaft, together with the cemented carbide sleeve and a disc spring, sandwiching them by fixing members, and cooling the spacer to apply a large lateral pressure to the disk spring, thereby pressing a side surface of the sleeve. However, such a fitting method uses large numbers of members such as a spacer, fixing members, etc. in a complicated assembling structure, needing high assembling accuracy. As a result, it impractically needs a large number of assembling steps and high cost.

To solve the above problems, the applicant discloses by JP 2002-301506 A a composite cemented carbide roll comprising an outer layer made of cemented carbide containing tungsten carbide particles, which is metallurgically bonded to an outer surface of an inner layer made of an iron-based material, one or more intermediate layers made of cemented carbide containing tungsten carbide particles being formed between the inner layer and the outer layer, and the amount of tungsten carbide particles in the intermediate layer being smaller than in the outer layer. JP 2002-301506 A describes that with such a structure, properties such as a thermal expansion coefficient, hardness and elastic modulus continuously change from the outer layer toward the inner layer, resulting in improved bonding strength of a boundary between the outer layer and the inner layer, and thus reducing circumferential and axial residual stress in and near the bonding boundary portion. Thus, the reliability of bonding between the inner layer and the outer layer of cemented carbide can be improved, providing a composite cemented carbide roll usable for severer rolling. JP 2002-301506 A discloses in Example 1 a composite cemented carbide roll comprising an outer layer having a composition comprising by mass 85% of WC, 9.3% of Co, 4.7% of Ni and 1% of Cr, an intermediate layer having a composition comprising by mass 30% of WC and 70% of Co, and an inner layer made of SNCM439 steel, which are integrated by a HIP treatment.

In general, in many rolling machines used for steel strips, backup rolls are arranged on both sides of rolling rolls to reduce the bending deformation of the rolling mills by a rolling load. During rolling, large stress is generated by a rolling load in contact regions of the rolling rolls and the backup rolls. The designing of a rolling roll should take strength for withstanding this stress into consideration.

Stress generated in a rolling roll by contact with a backup roll is known as Hertzian stress. A stress distribution near a contact surface of the roll depends on the depth from the contact surface. Particularly, shearing stress generated inside the rolling roll is maximum at the depth of several millimeters from the contact surface, though variable depending on the diameter of the roll and the load (see Plastic Working Technology Series 7, "Strip Rolling, 10.3 Hertzian Pressure and Fatigue," Corona Publishing Co., Ltd., pp. 257).

In the composite cemented carbide roll described in JP 2002-301506 A, in which an intermediate layer as thick as 0.2-2 mm is provided between an outer layer made of cemented carbide and an inner layer made of SNCM439, the shearing stress may be maximum near a boundary between the intermediate layer and the outer layer, inside the intermediate layer, near a boundary between the intermediate layer and the inner layer, or inside the inner layer, when the outer layer has been worn as thin as near the discard diameter of the roll. Because of the thermal expansion coefficient difference between the outer layer and the inner layer, the outer layer is subjected to residual compressive stress, so that residual tensile stress may be applied to the inner layer, and further to the intermediate layer as the case may be. When there is high residual tensile stress in the inner layer and the intermediate layer, a peak of the shearing stress generated at the depth of several millimeters from the roll surface by contact with a backup roll during rolling is superimposed to the above residual tensile stress, likely causing fatigue failure in the inner layer and the intermediate layer.

JP H5-171339 A discloses a WC—Co—Ni—Cr cemented carbide, in which WC+Cr is 95% or less by weight, Co+Ni is less than 10% by weight, and Cr/Co+Ni+Cr is 2-40%. JP H5-171339 A describes that because cemented carbide having such a composition has higher wear resistance and toughness than those of conventional composition alloys, it can be used for hot-rolling rolls and guide rollers, largely contributing to the reduction of a roll cost, such as increase in the rolling amount per caliber, the reduction of grinding depth, the reduction of breakage, etc. However, the rolling roll of cemented carbide composed of WC particles and a Co—Ni—Cr binder phase fails to conduct sufficient cold rolling of steel strips. Intensive research has revealed that such insufficient cold rolling is caused by in sufficient compression of steel strips, because the cemented carbide having a Co—Ni—Cr binder phase has as low compressive yield point as 300-500 MPa, suffering fine dents due to yield on the roll surface during the cold rolling of steel strips.

JP 2000-219931 A discloses a cemented carbide comprising 50-90% by mass of submicron WC and a binder phase having hardenability, the binder phase comprising 10-60% by mass of Co, less than 10% by mass of Ni, 0.2-0.8% by mass of C, and Cr and W, and optionally Mo and/or V, in addition to Fe, the molar ratios $X_C$, $X_{Cr}$, $X_W$, $X_{Mo}$ and $X_V$ of C, Cr, W, Mo and V in the binder phase meeting $2X_C<X_W+X_{Cr}+X_{Mo}+X_V<2.5X_C$, and the Cr content (% by mass)

meeting 0.03<Cr/[100−WC (% by mass)]<0.05. JP 2000-219931 A describes that this cemented carbide has high wear resistance by the binder phase having hardenability. However, because this cemented carbide contains 10-60% by mass of Co in the binder phase, it has insufficient hardenability for large products such as rolls, failing to exhibit sufficient compressive yield strength. Further, as fine WC particles as submicron provide this cemented carbide with poor toughness and thus poor cracking resistance, so that it is not usable for outer layers of rolling rolls.

In view of the above circumstances, a composite cemented carbide roll having sufficient compressive yield strength, thereby less suffering dents on the roll surface due to yield even when used in the cold rolling of metal strips, and capable of preventing fatigue failure from inner and intermediate layers, is desired.

OBJECTS OF THE INVENTION

Accordingly, an object of the present invention is to provide a composite cemented carbide roll suffering less dents on the roll surface even in the cold rolling of metal strips, by using outer and intermediate layers made of cemented carbide having high wear resistance and mechanical strength as well as sufficient compressive yield strength, on an inner layer made of steel.

Another object of the present invention is to provide a composite cemented carbide roll suffering no fatigue failure in an intermediate layer in repeated rolling.

SUMMARY OF THE INVENTION

As a result of intensive research on the composition and structure of a binder phase in cemented carbide in view of the above problems of prior art technologies, the inventors have found that the above objects can be achieved by a composite cemented carbide roll comprising outer and intermediate layers comprising WC particles and an Fe-based binder phase on an inner layer made of steel. The present invention has been completed based on such finding.

Thus, the composite cemented carbide roll of the present invention comprises an inner layer made of steel, an outer layer made of cemented carbide, and an intermediate layer made of cemented carbide, which is metallurgically bonded to the inner layer and the outer layer;

the cemented carbide forming the outer layer comprising 55-90 parts by mass of WC particles, and 10-45 parts by mass of a binder phase comprising Fe as a main component, the binder phase of the outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

the cemented carbide forming the intermediate layer comprising 30-65 parts by mass of WC particles, and 35-70 parts by mass of a binder phase comprising Fe as a main component, the binder phase of the intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities; and the amount c1 (parts by mass) of WC particles in the outer layer, and the amount c2 (parts by mass) of WC particles in the intermediate layer meeting $0.45 \leq c2/c1 \leq 0.85$.

The cemented carbides of the intermediate layer and the outer layer preferably contain substantially no composite carbides having equivalent circle diameters of 5 μm or more.

The WC particles preferably have a median diameter D50 of 0.5-10 μm.

The binder phases in the intermediate layer and the outer layer preferably further contain 0.2-2.0% by mass of Si, 0-5% by mass of Co, and 0-1% by mass of Mn.

The amount of bainite phases and/or martensite phases in the binder phases in the intermediate layer and the outer layer is preferably 50% or more by area in total.

At the initial diameter of the composite cemented carbide roll of the present invention, the outer layer is preferably as thick as 5-40 mm, and the intermediate layer is preferably as thick as 3-15 mm.

The composite cemented carbide roll of the present invention is preferably as thick as 8 mm or more from the roll surface to a boundary between the intermediate layer and the inner layer, at the discard diameter.

EFFECTS OF THE INVENTION

Because the generation of fine dents due to compressive yielding on the roll surface is suppressed in the composite cemented carbide roll of the present invention even when used for the cold rolling of metal (steel) strips, the high-quality cold rolling of steel strips can be continuously conducted, with a long life span.

DESCRIPTION OF THE PREFERRED EMBODIMENTS

Figure 1:
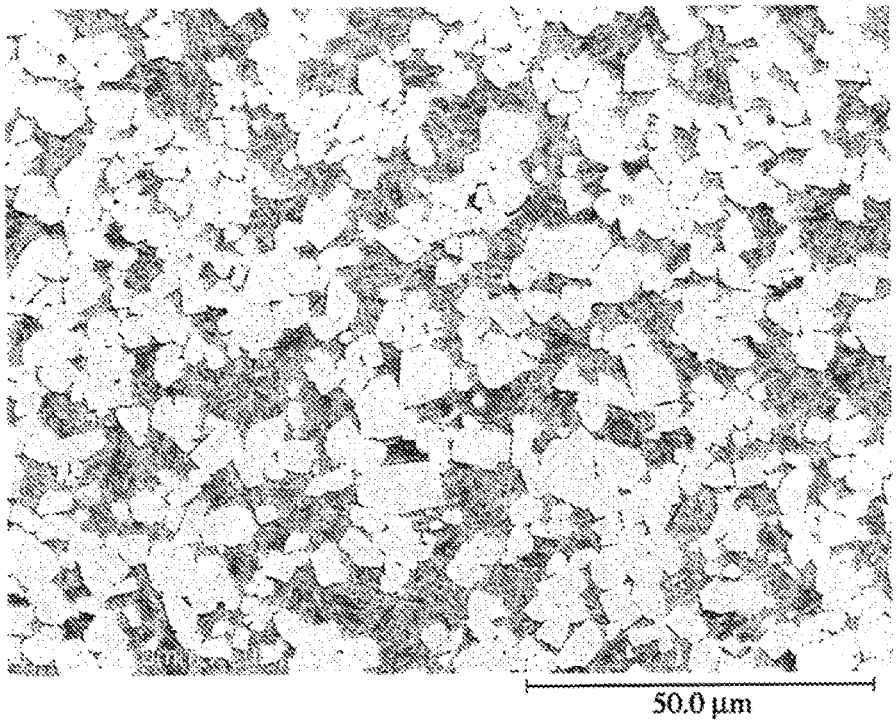
FIG. 1 is a SEM photograph showing a cross section structure of the cemented carbide of Sample 2.

The embodiments of the present invention will be explained in detail below. Explanations of one embodiment may be applicable to other embodiments unless otherwise mentioned. The following explanations are not restrictive, but various modifications may be made within the scope of the present invention.

[1] Composite Cemented Carbide Roll

The composite cemented carbide roll of the present invention comprises an inner layer made of steel, an outer layer made of cemented carbide, and an intermediate layer made of cemented carbide which is metallurgically bonded to the inner layer and the outer layer.

[1-1] Outer and Intermediate Layers (A) Composition

The cemented carbide forming the outer layer is composed of 55-90 parts by mass of WC particles, and 10-45 parts by mass of a binder phase comprising Fe as a main component, and the cemented carbide forming the intermediate layer is composed of 30-65 parts by mass of WC particles, and 35-70 parts by mass of binder phase comprising Fe as a main component.

The amount c1 of WC particles in the cemented carbide forming the outer layer is 55-90 parts by mass. When WC particles in the outer layer is less than 55 parts by mass, the amount of hard WC particles is relatively small, providing the cemented carbide with too low Young's modulus. On the other hand, when WC particles exceed 90 parts by mass, the amount of the binder phase is relatively small, failing to provide the cemented carbide with enough strength. The lower limit of the amount of WC particles in the outer layer is preferably 60 parts by mass, and more preferably 65 parts by mass. Also, the upper limit of the amount of WC particles in the outer layer is preferably 85 parts by mass.

To improve both bonding strength between the outer layer and the intermediate layer in their boundary, and bonding strength between the inner layer and the intermediate layer in their boundary, and to reduce circumferential and axial residual stress near the bonding boundary, the amount c2 of WC particles in the cemented carbide forming the intermediate layer is 30-65 parts by mass. The lower limit of the amount of WC particles in the intermediate layer is preferably 33 parts by mass, and more preferably 35 parts by mass. Also, the upper limit of the amount of WC particles in the intermediate layer is preferably 60 parts by mass, and more preferably 55 parts by mass.

Further, the amounts of WC particles in the outer and intermediate layers are set, such that the amount c1 (parts by mass) of WC particles in the outer layer and the amount c2 (parts by mass) of WC particles in the intermediate layer meet the formula of $0.45 \leq c2/c1 \leq 0.85$. In the composite cemented carbide roll of the present invention, in which the outer layer, the intermediate layer and the inner layer are metallurgically integrated by HIP as described below, by setting the amounts of WC particles in the outer and intermediate layers as described above, the thermal shrinkage of the intermediate layer can be made intermediate between those of the outer and inner layers without excessive difference in thermal shrinkage between the intermediate and outer layers, thereby reducing residual stress in a cooling process after HIP. The lower limit of c2/c1 is preferably 0.5, and more preferably 0.55. Also, the upper limit of c2/c1 is preferably 0.8, and more preferably 0.75.

(1) WC Particles

WC particles contained in the cemented carbide forming the outer and intermediate layers preferably have a median diameter D50 (corresponding to a particle size at a cumulative volume of 50%) of 0.5-10 μm. When the average particle size is less than 0.5 μm, there are increased boundaries between the WC particles and the binder phase, making it likely to generate composite carbides described below, thereby reducing the strength of the cemented carbide. On the other hand, when the average particle size exceeds 10 μm, the strength of the cemented carbide is lowered. The lower limit of the median diameter D50 of WC particles is preferably 1 μm, more preferably 2 μm, and most preferably 3 μm. Also, the upper limit of the median diameter D50 of WC particles is preferably 9 μm, more preferably 8 μm, and most preferably 7 μm.

Because WC particles densely exist in a connected manner in the cemented carbide, it is difficult to determine the particle sizes of WC particles on the photomicrograph. Because the cemented carbide of the present invention is produced by sintering a green body at a temperature between (liquid phase generation-starting temperature) and (liquid phase generation-starting temperature+100° C.) in vacuum as described below, there is substantially no particle size difference between WC powder in the green body and WC particles in the cemented carbide. Accordingly, the particle sizes of WC particles dispersed in the cemented carbide are expressed by the particle sizes of WC powder in the green body.

WC particles preferably have relatively uniform particle sizes. Accordingly, in a cumulative particle size distribution curve determined by a laser diffraction and scattering method, the WC particles have a preferable particle size distribution defined below. The lower limit of D10 (particle size at a cumulative volume of 10%) is preferably 0.3 μm, and more preferably 1 μm, and the upper limit of D10 is preferably 3 μm. Also, the lower limit of D90 (particle size at a cumulative volume of 90%) is preferably 3 μm, and more preferably 6 μm, and the upper limit of D90 is preferably 12 μm, and more preferably 8 μm. The median diameter D50 is as described above.

WC particles contained in the outer layer and the intermediate layer may be the same or different as long as they meet the above particle size distribution, though the use of the same WC particles is preferable.

(2) Binder Phase

In the cemented carbide forming the outer layer and the intermediate layer, the binder phase has a composition comprising 0.5-10% by mass of Ni,
0.2-2% by mass of C,
0.5-5% by mass of Cr, and
0.1-5% by mass of W,
the balance being Fe and inevitable impurities.

(i) Indispensable Elements (a) Ni: 0.5-10% by Mass

Ni is an element necessary for securing the hardenability of the binder phase. When Ni is less than 0.5% by mass, the binder phase has insufficient hardenability, likely lowering the strength of the cemented carbide. On the other hand, when Ni exceeds 10% by mass, the binder phase is turned to have an austenite phase, providing the cemented carbide with insufficient compressive yield strength. The lower limit of the Ni content is preferably 2.0% by mass, more preferably 2.5% by mass, further preferably 3% by mass, and most preferably 5% by mass. Also, the upper limit of the Ni content is preferably 8% by mass, and more preferably 7% by mass.

(b) C: 0.2-2.0% by Mass

C is an element necessary for securing the hardenability of the binder phase and suppressing the generation of composite carbides. When C is less than 0.2% by mass, the binder phase has insufficient hardenability, and large amounts of composite carbides are generated, resulting in low material strength. On the other hand, when C exceeds 2.0% by mass, coarse composite carbides are generated, providing the cemented carbide with low strength. The lower limit of the C content is preferably 0.3% by mass, and more preferably 0.5% by mass, and the upper limit of the C content is preferably 1.5% by mass, and more preferably 1.0% by mass.

(c) Cr: 0.5-5% by Mass

Cr is an element necessary for securing the hardenability of the binder phase. When Cr is less than 0.5% by mass, the binder phase has too low hardenability, failing to obtain sufficient compressive yield strength. On the other hand, when Cr exceeds 5% by mass, coarse composite carbides are generated, providing the cemented carbide with low strength. Cr is preferably 4% or less by mass, and more preferably 3% or less by mass.

(d) W: 0.1-5% by Mass

The W content in the binder phase is 0.1-5% by mass. When the W content in the binder phase exceeds 5% by mass, coarse composite carbides are generated, providing the cemented carbide with low strength. The lower limit of the W content is preferably 0.8% by mass, and more preferably 1.2% by mass. Also, the upper limit of the W content is preferably 4% by mass.

(ii) Optional Elements (a) Si: 0.2-2.0% by Mass

Si, which is an element strengthening the binder phase, may be contained if necessary. Less than 0.2% by mass of Si has substantially no effect of strengthening the binder phase. On the other hand, when Si is more than 2.0% by mass, graphite is likely crystallized, providing the cemented carbide with low strength. Accordingly, Si is preferably 0.2% or more by mass and 2.0% or less by mass, if contained. A further effect of strengthening the binder phase is exhibited when the Si content is 0.3% or more by mass, particularly when it is 0.5% or more by mass. Also, the upper limit of the Si content is preferably 1.9% by mass.

(b) Co: 0-5% by Mass

Co, which has a function of improving sinterability, is not indispensable in the cemented carbide of the present invention. Namely, the Co content is preferably substantially 0% by mass. However, 5% or less by mass of Co does not affect the structure and strength of the cemented carbide. The upper limit of the Co content is more preferably 2% by mass, and most preferably 1% by mass.

(c) Mn: 0-5% by Mass

Mn, which has a function of improving hardenability, is not indispensable in the cemented carbide of the present invention. Namely, the Mn content is preferably substantially 0% by mass. However, 5% or less by mass of Mn does not affect the structure and strength of the cemented carbide. The upper limit of the Mn content is more preferably 2% by mass, and most preferably 1% by mass.

(iii) Inevitable Impurities

The inevitable impurities include Mo, V, Nb, Ti, Al, Cu, N, O, etc. Among them, at least one selected from the group consisting of Mo, V and Nb is preferably 2% or less by mass in total. At least one selected from the group consisting of Mo, V and Nb is more preferably 1% or less by mass, and most preferably 0.5% or less by mass, in total. Also, at least one selected from the group consisting of Ti, Al, Cu, N and O is preferably 0.5% or less by mass alone and 1% or less by mass in total. Particularly, each of N and O is preferably less than 1000 ppm. The inevitable impurities within the above ranges do not substantially affect the structure and strength of the cemented carbide.

Though the binder phases in the cemented carbides forming the outer layer and the intermediate layer may have the same or different compositions, they preferably have the same composition.

(B) Structure (1) Composite Carbides

The structure of the cemented carbides forming the outer layer and the intermediate layer mainly comprise WC particles and binder phases, preferably with substantially no composite carbides having equivalent circle diameters of 5 μm or more. The composite carbides are those composed of W and metal elements, for example, $(W, Fe, Cr)_{23}C_6$, $(W, Fe, Cr)_3C$, $(W, Fe, Cr)_2C$, $(W, Fe, Cr)_7C_3$, $(W, Fe, Cr)_6C$, etc. Herein, the equivalent circle diameter of a composite carbide is a diameter of a circle having the same area as that of the composite carbide particle in a photomicrograph (about 1000 times) of a polished cross section of the cemented carbide. The cemented carbide containing no composite carbides having equivalent circle diameters of 5 μm or more in the binder phase has bending strength of 1700 MPa or more. Herein, "containing substantially no composite carbides" means that composite carbides having equivalent circle diameters of 5 μm or more are not observed on a SEM photograph (1000 times). Composite carbides having equivalent circle diameters of less than 5 μm may exist in an amount of less than about 5% by area when measured by EPMA, in the cemented carbides forming the outer and intermediate layers of the composite cemented carbide roll of the present invention.

(2) Bainite Phase and/or Martensite Phase

The binder phases in the cemented carbides forming the outer layer and the intermediate layer preferably have a structure containing 50% or more in total by area of bainite phases and/or martensite phases. The use of the term "bainite phases and/or martensite phases" is due to the fact that bainite phases and martensite phases have substantially the same function, and that it is difficult to distinguish them on a photomicrograph. With such structure, the cemented carbides forming the outer layer and the intermediate layer in the composite cemented carbide roll of the present invention have high compressive yield strength and mechanical strength.

Because the total amount of bainite phases and/or martensite phases in the binder phase is 50% or more by area, the cemented carbide has compressive yield strength of 1200 MPa or more. The total amount of bainite phases and/or martensite phases is preferably 70% or more by area, more preferably 80% or more by area, and most preferably substantially 100% by area. Other phases than bainite phases and martensite phases are pearlite phases, austenite phases, etc.

(3) Diffusion of Fe into WC Particles

EPMA analysis has revealed that in the cemented carbides forming the outer layer and the intermediate layer in the composite cemented carbide roll of the present invention, WC particles contain 0.3-0.7% by mass of Fe.

(C) Structure

At the initial diameter, the outer layer is preferably as thick as 5-40 mm, and the intermediate layer is preferably as thick as 3-15 mm. The initial diameter herein means a diameter of the composite cemented carbide roll at the start of use. Also, the composite roll is preferably as thick as 8 mm or more from the surface to a boundary between the intermediate layer and the inner layer, at the discard diameter. The discard diameter herein means the minimum usable diameter of a roll, which gradually decreases from the initial diameter by surface wearing of the outer layer by rolling. The discard diameter is usually determined by roll users and roll producers. The outer layer between the initial diameter and the discard diameter is actually used for rolling, and this size is set for the specification of each mill. A larger usable range for rolling is obtained by a thicker outer layer, but the thicker outer layer provides higher residual tensile stress on the inner layer by metallurgical bonding of the intermediate layer and the inner layer. Accordingly, too thick an outer layer makes an inner layer insufficient in terms of strength. The intermediate layer made of an intermediate material between those of the outer layer and the inner layer is provided between the outer layer and the inner layer to alleviate drastic stress change. Also, when the outer layer becomes thinner to the discard diameter by using, etc., the intermediate layer secures enough distance from the rolling surface to the inner layer. As described above, the maximum shearing stress is applied to an inner portion of the roll several millimeters from the rolling surface by Hertzian pressure acting on the roll during rolling. If the maximum shearing stress were applied to the inner layer and the intermediate layer subjected to residual tensile stress, the roll would likely be broken by fatigue. To prevent this, it is preferable that the material and production method of the intermediate layer are optimized to prevent high residual tensile stress, and that at the discard diameter, the total thickness of the outer layer and the intermediate layer is 8 mm or more, such that the maximum shearing stress is applied to the intermediate layer or the outer layer, not to the inner layer subjected to residual tensile stress.

(D) Properties

The cemented carbide having the above composition and structure has compressive yield strength of 1200 MPa or more and bending strength of 1700 MPa or more. Accordingly, when the composite roll having outer and intermediate layers made of such cemented carbide is used for the cold rolling of metal (steel) strips, dents due to the compressive yielding of the roll surface can be reduced, enabling the continuous high-quality rolling of metal strips with a long life span of the rolling roll. Also, fatigue failure from the intermediate layer and the inner layer can be prevented in repeated rolling, resulting in a long life span of the rolling roll. Of course, the composite cemented carbide roll of the present invention can also be used for the hot-rolling of metal strips.

Figure 2:
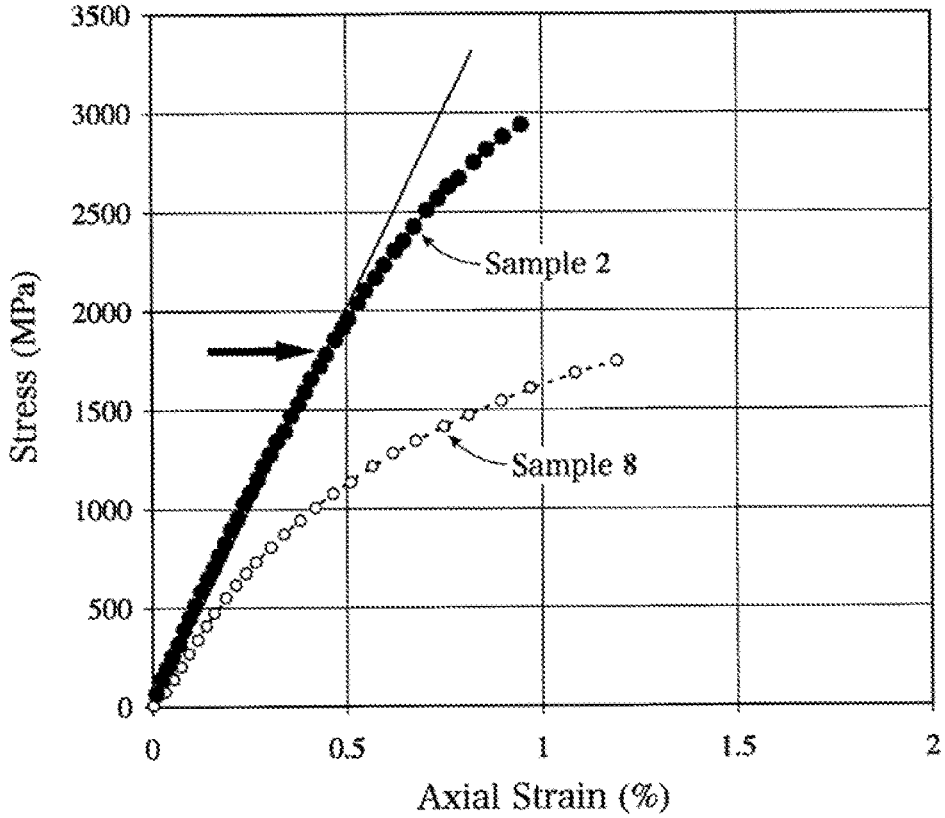
FIG. 2 is a graph showing the stress-strain curves of Samples 2 and 8, which were obtained by a uniaxial compression test.
Figure 3:
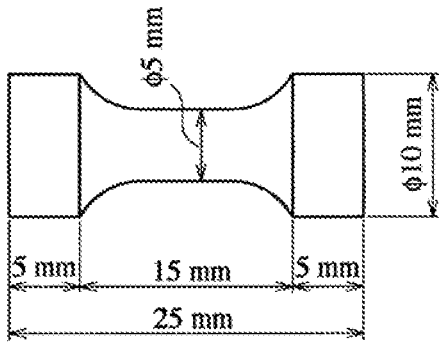
FIG. 3 is a schematic view showing a test piece used in the uniaxial compression test.

The compressive yield strength is yield stress determined by a uniaxial compression test using a test piece shown in FIG. 3, which is subjected to an axial load. Namely, in a stress-strain curve determined by the uniaxial compression test as shown in FIG. 2, stress at a point at which the stress and the strain deviate from a straight linear relation is defined as the compressive yielding.

The cemented carbides forming the outer layer and the intermediate layer have compressive yield strength of more preferably 1500 MPa or more, and most preferably 1600 MPa or more, and bending strength of more preferably 2000 MPa or more, and most preferably 2300 MPa or more.

The cemented carbides forming the outer layer and the intermediate layer further have Young's modulus of 385 GPa or more and Rockwell hardness of 80 HRA or more. The Young's modulus is preferably 400 GPa or more, and more preferably 450 GPa or more. Also, the Rockwell hardness is preferably 82 HRA or more.

[1-2] Inner Layer

The inner layer is preferably made of an iron-based alloy, particularly steel or cast steel having excellent toughness. Preferable among them is an iron-based alloy containing 2.0% or more in total by mass of at least one selected from the group consisting of Cr, Ni and Mo. A particularly preferable iron-based alloy comprises 0.2-0.45% by mass of C, 0.5-4.0% by mass of Cr, 1.44.0% by mass of Ni, and 0.10-1.0% by mass of Mo, the balance being Fe and inevitable impurities. Using such an iron-based alloy for the inner layer, bainite or martensite transformation can occur in the inner layer in a cooling process after the metallurgical bonding of the outer layer, the intermediate layer and the inner layer, thereby reducing the thermal expansion difference between the inner layer and the low-thermal expansion cemented carbide to reduce residual stress in the outer and intermediate layers.

[2] Production Method of Composite Cemented Carbide Roll (A-1) Powder for Molding (Outer Layer)

55-90 parts by mass of WC powder, and 10-45 parts by mass of a metal powder comprising 0.5-10% by mass of Ni, 0.3-2.2% by mass of C, and 0.5-5% by mass of Cr, the balance being Fe and inevitable impurities, are wet-mixed in a ball mill, etc., and dried to prepare a powder for molding of the cemented carbide for the outer layer. Because W is diffused from the WC powder to the binder phase during sintering, the metal powder may not contain W. The WC powder content is preferably 60-90 parts by mass, and more preferably 65-90 parts by mass. The upper limit of the WC powder content is preferably 85 parts by mass. To prevent the generation of composite carbides, the amount of C in the metal powder should be 0.3-2.2% by mass, and is preferably 0.5-1.7% by mass, and more preferably 0.5-1.5% by mass.

(A-2) Powder for Molding (Intermediate Layer)

30-65 parts by mass of WC powder, and 35-70 parts by mass of a metal powder comprising 0.5-10% by mass of Ni, 0.3-2.2% by mass of C, and 0.5-5% by mass of Cr, the balance being Fe and inevitable impurities, are wet-mixed in a ball mill, etc., and dried to prepare the powder for molding of the cemented carbide for the intermediate layer. Because W is diffused from the WC powder to the binder phase during sintering, the metal powder may not contain W. The WC powder content is preferably 33-65 parts by mass, and more preferably 35-65 parts by mass. The upper limit of the WC powder content is preferably 60 parts by mass. To prevent the generation of composite carbides, C in the metal powder should be 0.3-2.2% by mass, and is preferably 0.5-1.7% by mass, and more preferably 0.5-1.5% by mass.

The metal powder for forming the binder phases in the outer and intermediate layers may be a mixture of constituent element powders, or alloy powder containing all constituent elements. Carbon may be added in the form of powder such as graphite, carbon black, etc., or may be added to powder of each metal or alloy. Each metal or alloy powder, for example, Fe powder, Ni powder, Co powder, Mn powder and Cr powder, preferably has a median diameter D50 of 1-10 μm (B) Molding of Outer and Intermediate Layers The above powders for molding are formed into hollow cylindrical bodies by a method such as die-pressing, cold-isostatic pressing (CIP), etc., to obtain green bodies for the outer and intermediate layers.

(C) Sintering

Figure 4:
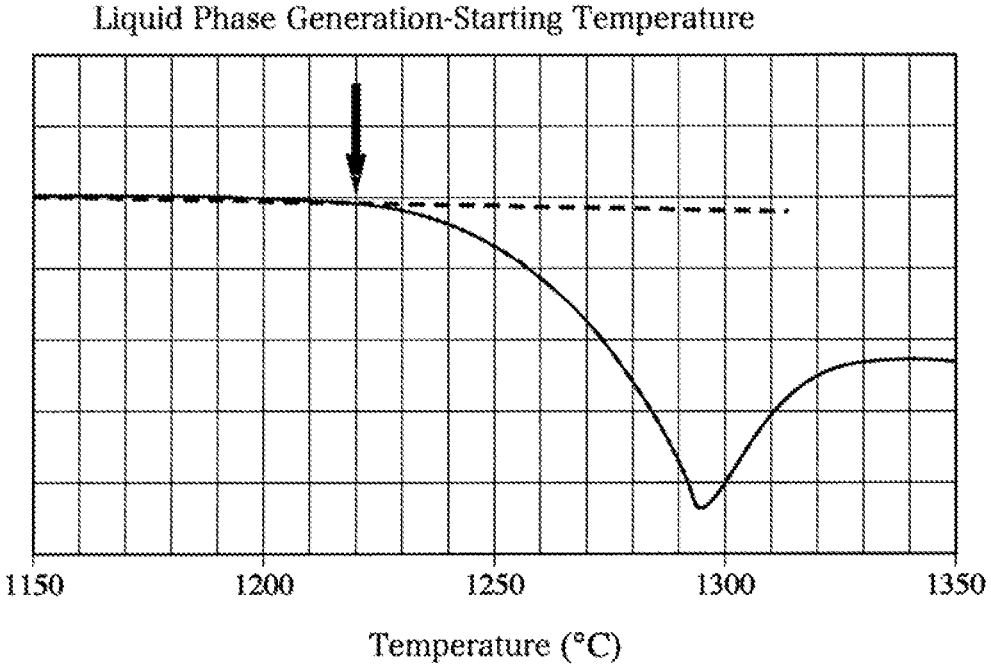
FIG. 4 is a graph showing an example of liquid phase generation-starting temperatures measured by a differential thermal analyzer.

The green body is sintered at a temperature from (liquid phase generation-starting temperature) to (liquid phase generation-starting temperature+100° C.) in vacuum. The liquid phase generation-starting temperature of the green body is a temperature at which the generation of a liquid phase starts in the heating process of sintering, which is measured by a differential thermal analyzer. FIG. 4 shows an example of the measurement results. The liquid phase generation-starting temperature of the green body is a temperature at which an endothermic reaction starts as shown by an arrow in FIG. 4. When sintered at a higher temperature than the liquid phase generation-starting temperature+100° C., coarse composite carbides are formed, providing the resultant cemented carbide with low strength. On the other hand, when sintered at a lower temperature than the liquid phase generation-starting temperature, densification is insufficient, also providing the resultant cemented carbide with low strength. The lower limit of the sintering temperature is preferably the liquid phase generation-starting temperature+10° C., and the upper limit of the sintering temperature is preferably the liquid phase generation-starting temperature+90° C., and more preferably the liquid phase generation-starting temperature+80° C.

(D) HIP

The sintered bodies for the intermediate layer and the outer layer are arranged around the inner layer, and inserted into a HIP can, which is evacuated and sealed by welding. Thereafter, HIP is conducted to integrate the inner layer, the intermediate layer and the outer layer. The inner layer is preferably made of, for example, an iron-based alloy containing 2.0% or more in total by mass of at least one selected from the group consisting of Cr, Ni and Mo. In the HIP, the temperature is preferably 1100-1350° C., and the pressure is preferably 50 MPa or more.

(E) Cooling

The HIPed body is cooled at an average rate of 60° C./hour or more between 900° C. and 600° C. When cooled at an average rate of less than 60° C./hour, the binder phase in the cemented carbide contains a large percentage of pearlite phases, failing to have 50% or more in total by area of bainite phases and/or martensite phases, thereby providing the cemented carbide with low compressive yield strength. Cooling at an average rate of 60° C./hour or more may be conducted in the cooling process of HIP in a HIP furnace, or after heating to 900° C. or higher again.

(F) Working

After removing the HIP can by machining after the HIP, an outer surface of the integrated composite cemented carbide roll is ground to obtain a usable composite cemented carbide roll. The outer layer is preferably ground to have surface roughness Ra of 0.1-1.2 μm, to prevent the slipping of a steel strip being rolled while keeping enough thickness of a lubricant film, in the cold rolling of strips by the composite cemented carbide roll of the present invention. The lower limit of the surface roughness Ra of the outer layer is preferably 0.2 μm, and more preferably 0.3 μm. The upper limit of the surface roughness Ra of the outer layer is preferably 1 μm, and more preferably 0.9 μm. Incidentally, the optimum surface roughness differs depending on stands in which the rolling rolls are used. Ra is preferably 0.6-0.9 μm, and more preferably 0.7-0.8 μm in front stands, and preferably 0.2-0.5 μm, and more preferably 0.3-0.4 μm in finishing stands.

In order for the outer layer to have surface roughness Ra of 0.3-1.2 μm, a peripheral surface of the outer layer is ground by a diamond grinder. The diamond grinder preferably has particle sizes of #100 to #180. Though various binders may be used for the diamond grinder, a metal bond grinder and a vitrified bond grinder are preferable.

Because the composite cemented carbide roll of the present invention has outer and intermediate layers made of cemented carbide having high compressive yield strength, bending strength, Young's modulus and hardness, it is particularly suitable for the cold rolling of metal (steel) strips. The composite cemented carbide roll of the present invention is preferably used as a work roll in (a) a 6-roll stand comprising a pair of upper and lower work rolls for rolling a metal strip, a pair of upper and lower intermediate rolls for supporting the work rolls, and a pair of upper and lower backup rolls for supporting the intermediate rolls, or (b) a 4-roll stand comprising a pair of upper and lower work rolls for rolling metal strips, and a pair of upper and lower backup rolls for supporting the work rolls. At least one stand described above is preferably arranged in a tandem mill comprising pluralities of stands.

The present invention will be explained in further detail by Examples below, without intention of restricting the present invention thereto.

Reference Example 1

WC powder [purity: 99.9%, and D10: 4.3 μm, median diameter D50: 6.4 μm, and D90: 9.0 μm, which were measured by a laser diffraction particle size distribution meter (SALD-2200 available from Shimadzu Corporation)], and a binder phase-forming powder having the composition shown in Table 1 were mixed at ratios shown in Table 2, to prepare mixture powders (Samples 1-10). Each binder phase-forming powder had a median diameter D50 of 1-10 μm, and contained trace amounts of inevitable impurities.

Each of the mixture powders was wet-mixed for 20 hours in a ball mill, dried, and then pressed at pressure of 98 MPa to form a cylindrical green body (Samples 1-10) of 60 mm in diameter and 40 mm in height. The liquid phase generation-starting temperature of a test piece of 1 mm×1 mm×2 mm cut out of each green body was measured by a differential thermal analyzer. The results are shown in Table 3.

TABLE 1

| Sample | Composition of Binder Phase-Forming Powder (% by mass) | | | | | | | | |
|---|---|---|---|---|---|---|---|---|---|
| No. | Si | Mn | Ni | Cr | Mo | V | C | Co(1) | Fe(1) |
| 1 | 0.80 | — | 5.02 | 1.21 | — | — | 1.29 | — | Bal. |
| 2 | 0.80 | — | 5.02 | 1.21 | — | — | 1.29 | — | Bal. |
| 3 | 0.81 | — | 5.05 | 1.21 | — | — | 0.79 | — | Bal. |
| 4 | 1.61 | — | 5.02 | 2.41 | — | — | 1.27 | — | Bal. |
| 5 | 0.80 | — | 5.02 | 4.02 | — | — | 1.26 | — | Bal. |
| 6 | 0.80 | — | 2.61 | 3.52 | — | — | 1.29 | — | Bal. |
| 7* | 0.92 | 0.45 | 0.17 | 5.13 | 1.31 | 0.88 | 0.71 | — | Bal. |
| 8* | — | — | 5.43 | — | — | — | 1.30 | — | Bal. |
| 9 | 0.80 | — | 5.00 | 2.40 | — | — | 1.77 | — | Bal. |
| 10* | — | — | 31.13 | 6.67 | — | — | — | Bal. | — |

Note:
*denotes "a sample outside the composition range of the cemented carbide used for the outer layer of the composite cemented carbide roll of the present invention."
(1)The balance includes inevitable impurities.

TABLE 2

| Sample No. | WC Powder (parts by mass) | Binder Phase Powder (parts by mass) |
|---|---|---|
| 1 | 80 | 20 |
| 2 | 70 | 30 |
| 3 | 70 | 30 |
| 4 | 70 | 30 |
| 5 | 70 | 30 |
| 6 | 70 | 30 |
| 7* | 70 | 30 |
| 8* | 70 | 30 |
| 9 | 70 | 30 |
| 10* | 85 | 15 |

Note:
*denotes "a sample outside the composition range of the cemented carbide used in the outer layer of the composite cemented carbide roll of the present invention."

TABLE 3

| Sample No. | Liquid Phase Generation-Starting Temperature (° C.) |
|---|---|
| 1 | 1210 |
| 2 | 1210 |
| 3 | 1230 |
| 4 | 1210 |
| 5 | 1210 |
| 6 | 1210 |
| 7* | 1160 |
| 8* | 1220 |
| 9 | 1200 |
| 10* | 1310 |

Note:
*denotes "a sample outside the composition range of the cemented carbide used in the outer layer of the composite cemented carbide roll of the present invention."

Each green body was sintered in vacuum under the conditions shown in Table 4, and then subjected to HIP under the conditions shown in Table 4 to produce the cemented carbides of Samples 1-10. Each cemented carbide was evaluated by the following methods. Incidentally, Samples 7, 8 and 10 are those outside the composition range of the cemented carbide used in the outer layer of the composite cemented carbide roll of the present invention.

TABLE 4

| | Vacuum Sintering | | HIP | | | Cooling |
|---|---|---|---|---|---|---|
| Sample No. | Sintering Temperature (° C.) | Holding Time (hours) | Treatment Temperature (° C.) | Pressure (MPa) | Holding Time (hour) | Average Rate(1) (° C./hour) |
| 1 | 1260 | 2 | 1230 | 140 | 2 | 100 |
| 2 | 1260 | 2 | 1230 | 140 | 2 | 100 |
| 3 | 1280 | 2 | 1230 | 140 | 2 | 100 |
| 4 | 1260 | 2 | 1230 | 140 | 2 | 100 |
| 5 | 1260 | 2 | 1230 | 140 | 2 | 100 |
| 6 | 1260 | 2 | 1230 | 140 | 2 | 100 |
| 7* | 1350 | 2 | 1230 | 140 | 2 | 100 |
| 8* | 1330 | 2 | 1230 | 140 | 2 | 100 |
| 9 | 1260 | 2 | 1230 | 140 | 2 | 100 |
| 10* | 1400 | 2 | 1350 | 140 | 2 | 100 |

Note:
*denotes "a sample outside the composition range of the cemented carbide used in the outer layer of the composite cemented carbide roll of the present invention."
(1)An average cooling rate between 900° C. and 600° C.

Each compression test piece shown in FIG. 3 was cut out of each cemented carbide, and a strain gauge was attached to a center portion surface thereof to obtain a stress-strain curve under an axial load. In the stress-strain curve, stress at a point at which the stress and the strain deviated from a straight linear relation was regarded as the compressive yield strength. The results are shown in Table 5.

(2) Bending Strength

A test piece of 4 mm×3 mm×40 mm cut out of each cemented carbide was measured with respect to bending strength under 4-point bending conditions with an interfulcrum distance of 30 mm. The results are shown in Table 5.

(3) Young's Modulus

A test piece of 10 mm in width, 60 mm in length and 1.5 mm in thickness, which was cut out of each cemented carbide, was measured by a free-resonance intrinsic vibration method (IS Z2280). The results are shown in Table 5.

(4) Hardness

The Rockwell hardness (A scale) of each cemented carbide was measured. The results are shown in Table 5.

TABLE 5

| Sample No. | Compressive Yield Strength (MPa) | Bending Strength (MPa) | Young's Modulus (GPa) | Hardness (HRA) |
|---|---|---|---|---|
| 1 | 1780 | 2574 | 534 | 86.1 |
| 2 | 1800 | 2714 | 496 | 84.4 |

TABLE 5-continued

| Sample No. | Compressive Yield Strength (MPa) | Bending Strength (MPa) | Young's Modulus (GPa) | Hardness (HRA) |
|---|---|---|---|---|
| 3 | 1550 | 2490 | 496 | 84.2 |
| 4 | 1720 | 2126 | 496 | 84.3 |
| 5 | 1700 | 1766 | 496 | 82.6 |
| 6 | 2000 | 2019 | 496 | 85.1 |
| 7* | 2200 | 1470 | 494 | 85.1 |
| 8* | 300 | 1786 | 496 | 79.4 |
| 9 | 1680 | 1430 | 496 | 84.2 |
| 10* | 400 | 2580 | 535 | 84.2 |

Note:
*denotes "a sample outside the composition range of the cemented carbide used in the outer layer of the composite cemented carbide roll of the present invention."

(5) Observation of Structure

Each sample was mirror-polished, and observed by SEM to determine the presence or absence of composite carbides, and the total area ratio of bainite phases and martensite phases in the binder phase. The results are shown in Table 6. FIG. 1 is a SEM photograph of the cemented carbide of Sample 2, in which white particles are WC particles, and gray portions are a binder phase.

TABLE 6

| Sample No. | Bainite Phase and/or Martensite Phase (1) | Composite Carbides (2) |
|---|---|---|
| 1 | 50% by area or more | No |
| 2 | 50% by area or more | No |
| 3 | 50% by area or more | No |
| 4 | 50% by area or more | No |
| 5 | 50% by area or more | No |
| 6 | 50% by area or more | No |
| 7* | 50% by area or more | Yes |
| 8* | Less than 50% by area | No |
| 9 | 50% by area or more | Yes |
| 10* | Not Evaluated | No |

Note:
*denotes "a sample outside the composition range of the cemented carbide used in the outer layer of the composite cemented carbide roll of the present invention."

(1) The total area ratio (%) of bainite phases and martensite phases in the binder phase.

(2) The presence or absence of composite carbides having diameters of 5 μm or more in the binder phase.

(6) Composition of Binder Phase

The composition of the binder phase in each sample was measured by a field emission electron probe microanalyzer (FE-EPMA). Point analysis was conducted with a beam diameter of 1 μm at 10 arbitrary points in portions other than WC particles, and the measured values were averaged to determine the composition of the binder phase. The results are shown in Table 7. WC particles and composite carbides were similarly point-analyzed to measure the amount ratio of W to C, thereby identifying them.

TABLE 7

| Sample | Composition of Binder Phase (% by mass)(1) | | | | | | | | | |
|---|---|---|---|---|---|---|---|---|---|---|
| No. | Si | Mn | Ni | Cr | W | Mo | V | C | Co(2) | Fe(2) |
| 1 | 0.91 | — | 4.92 | 0.89 | 1.60 | — | — | 0.81 | — | Bal. |
| 2 | 0.93 | — | 4.89 | 0.94 | 1.63 | — | — | 0.83 | — | Bal. |
| 3 | 0.84 | — | 4.82 | 0.94 | 2.29 | — | — | 0.69 | — | Bal. |
| 4 | 1.84 | — | 4.84 | 1.75 | 1.47 | — | — | 0.74 | — | Bal. |
| 5 | 0.90 | — | 4.92 | 3.39 | 1.65 | — | — | 0.88 | — | Bal. |
| 6 | 0.84 | — | 2.60 | 2.82 | 1.70 | — | — | 0.88 | — | Bal. |

TABLE 7-continued

| Sample | Composition of Binder Phase (% by mass)[1] | | | | | | | | | |
|---|---|---|---|---|---|---|---|---|---|---|
| No. | Si | Mn | Ni | Cr | W | Mo | V | C | Co[2] | Fe[2] |
| 7* | 0.70 | 0.24 | 0.19 | 4.03 | 1.48 | 0.17 | 0.14 | 0.70 | — | Bal. |
| 8* | — | — | 4.83 | — | 1.15 | — | — | 0.31 | — | Bal. |
| 9 | 0.97 | — | 5.10 | 0.70 | 1.11 | — | — | 0.88 | — | Bal. |
| 10* | — | — | 31.27 | 6.53 | — | — | — | — | Bal. | — |

Note:
*denotes "a sample outside the composition range of the cemented carbide used in the outer layer of the composite cemented carbide roll of the present invention."
[1]Analyzed values.
[2]The balance includes inevitable impurities.

Reference Example 2

Using a powder for molding having the same composition as that of Sample 1 in Reference Example 1, a solid cylindrical green body was formed by the same method as in Reference Example 1. The green body was sintered in the same manner as in Reference Example 1 to form an integral roll of 44 mm in diameter and 620 mm in length. Using this roll, a pure-Ni strip as thick as 0.6 mm was cold-rolled without suffering defects due to dents on the roll surface.

Using a powder for molding having the same composition as that of Sample 10 in Reference Example 1, an integral roll of 44 mm in diameter and 620 mm in length was similarly formed. When this roll was used in the rolling of a pure-Ni strip as thick as 0.6 mm, the pure-Ni strip suffered defects due to dents on the roll surface.

Examples 1-4 and Comparative Examples 1 and 2

Using the same materials as those of Sample 1 in Reference Example 1, powders for molding having the compositions shown in Table 8 were prepared, and formed into hollow cylindrical green bodies for outer and intermediate layers by cold-isostatic pressing (CIP). Like Sample 1 in Reference Example 1, the green bodies were sintered in vacuum under the conditions shown in Table 9, and ground to produce hollow cylindrical sintered bodies having the shapes shown in Table 10 for the outer and intermediate layers of Examples 1-4, and Comparative Examples 1 and 2.

TABLE 8

| Layer | Components | | Ex. 1 | Ex. 2 | Ex. 3 | Ex. 4 | Com. Ex. 1 | Com. Ex. 2 |
|---|---|---|---|---|---|---|---|---|
| Outer Layer | WC Par-ticles | Ratio[1] | 80 | 80 | 70 | 70 | 80 | 80 |
| | | D50 (μm) | 6.4 | 6.4 | 6.4 | 5.5 | 5.5 | 5.5 |
| | Binder Phase | Si | 0.8 | 0.8 | 0.8 | 0.8 | 0.8 | 0.8 |
| | | Ni | 5 | 5 | 5 | 5 | 5 | 5 |
| | | Cr | 1.2 | 1.2 | 1.2 | 1.2 | 1.2 | 1.2 |
| | | C | 1.3 | 1.3 | 1.3 | 1.3 | 1.3 | 1.3 |
| | | Fe[3] | Bal. | Bal. | Bal. | Bal. | Bal. | Bal. |
| Inter-mediate Layer | WC Par-ticles | Ratio[1] | 50 | 50 | 50 | 35 | 35 | 50 |
| | | D50 (μm) | 6.4 | 6.4 | 6.4 | 5.5 | 5.5 | 5.5 |
| | | c2/c1[4] | 63% | 63% | 71% | 50% | 44% | 63% |
| | Binder Phase | Si | 0.8 | 0.8 | 0.8 | 0.8 | 0.8 | 0 |
| | | Ni | 5 | 5 | 5 | 5 | 5 | 50 |
| | | Cr | 1.2 | 1.2 | 1.2 | 1.2 | 1.2 | 0 |
| | | C | 1.3 | 1.3 | 1.3 | 1.3 | 1.3 | 1.3 |
| | | Fe[3] | Bal. | Bal. | Bal. | Bal. | Bal. | Bal. |

[1]A ratio (% by mass) per the total amount of WC powder and the binder phase-forming powder.
[2]The percentage (% by mass) of each metal in the composition of the binder phase powder.
[3]The balance includes inevitable impurities.
[4]c2/c1 = (ratio of WC particles in intermediate layer)/(ratio of WC particles in outer layer) × 100.

TABLE 9

| Layer | Sintering Conditions | Ex. 1 | Ex. 2 | Ex. 3 | Ex. 4 | Com. Ex. 1 | Com. Ex. 2 |
|---|---|---|---|---|---|---|---|
| Outer Layer | Temperature | 1230° C. | 1230° C. | 1230° C. | 1260° C. | 1260° C. | 1260° C. |
| | Time | 2 hr | 2 hr | 2 hr | 2 hr | 2 hr | 2 hr |
| | Atmosphere | Vacuum | Vacuum | Vacuum | Vacuum | Vacuum | Vacuum |
| Intermediate Layer | Temperature | 1230° C. | 1230° C. | 1230° C. | 1230° C. | 1230° C. | 1100° C. |
| | Time | 2 hr | 2 hr | 2 hr | 2 hr | 2 hr | 2 hr |
| | Atmosphere | Vacuum | Vacuum | Vacuum | Vacuum | Vacuum | Vacuum |

TABLE 10

| Layer | Shape of Sintered Body (mm) | Ex. 1 | Ex. 2 | Ex. 3 | Ex. 4 | Com. Ex. 1 | Com. Ex. 2 |
|---|---|---|---|---|---|---|---|
| Outer Layer | Outer Diameter | 310 | 310 | 200 | 310 | 310 | 310 |
| | Inner Diameter | 272 | 272 | 171 | 265 | 265 | 272 |
| | Length | 500 | 750 | 600 | 550 | 550 | 550 |
| Intermediate Layer | Outer Diameter | 272 | 272 | 171 | 265 | 265 | 272 |
| | Inner Diameter | 248 | 248 | 152 | 255 | 255 | 248 |
| | Length | 500 | 750 | 600 | 550 | 550 | 550 |

The hollow cylindrical sintered body for an intermediate layer was arranged around the solid cylindrical inner layer shown in Table 11, and the hollow cylindrical sintered body for an outer layer was arranged therearound. The hollow cylindrical sintered body for the outer layer was covered with a first hollow cylindrical HIP can, and the inner layer was covered with second hollow cylindrical HIP cans having flanges welded to the first hollow cylindrical HIP can. A disc-shaped HIP can was welded to the flange of each second hollow cylindrical HIP can. Thereafter, the HIP can was evacuated through an evacuation pipe and then sealed. With the HIP can placed in a HIP furnace, HIP was conducted at 1230° C. and 140 MPa for 2 hours. The HIPed outer and intermediate layers were cooled at an average rate of 80-100° C./hour.

TABLE 11

| Shape and Material of Inner Layer | Ex. 1 | Ex. 2 | Ex. 3 | Ex. 4 | Com. Ex. 1 | Com. Ex. 2 |
|---|---|---|---|---|---|---|
| Outer Diameter | 248 | 248 | 152 | 255 | 255 | 248 |
| Length | 1220 | 1575 | 1320 | 1320 | 1320 | 1320 |
| Material | SNCM630 | SNCM630 | SNCM439 | SNCM439 | SNCM630 | SNCM630 |

Figure 5:
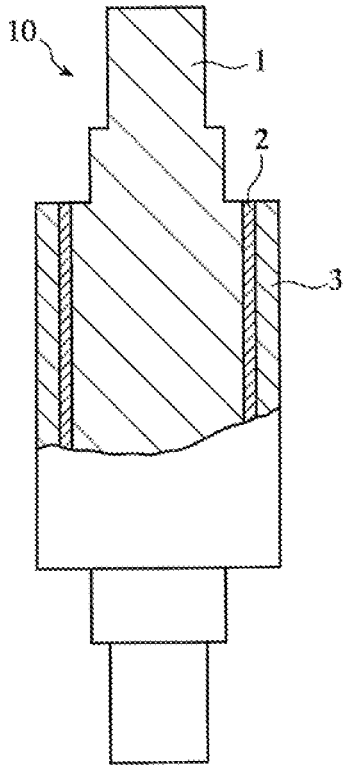
FIG. 5 is a partial cross-sectional view showing an example of the composite cemented carbide rolls of the present invention.

After removing the HIP can by machining, the outer surface of the sintered body was ground to obtain a composite cemented carbide roll 10 comprising the inner layer 1 made of steel, and the outer layer 3 made of cemented carbide, which was metallurgically bonded to the inner layer 1 via the intermediate layer 2 made of cemented carbide as shown in FIG. 5. The shape of each sample is shown in Table 12.

TABLE 12

| Size (mm) | Ex. 1 | Ex. 2 | Ex. 3 | Ex. 4 | Com. Ex. 1 | Com. Ex. 2 |
|---|---|---|---|---|---|---|
| Outer Diameter | 305 | 305 | 194 | 304 | 304 | 304 |
| Length of Outer Layer | 400 | 700 | 500 | 500 | 500 | 500 |
| Entire Length | 1200 | 1525 | 1300 | 1300 | 1300 | 1300 |
| Thickness of Outer Layer | 17 | 17 | 12 | 24 | 24 | 16 |
| Thickness of Intermediate Layer | 11.5 | 11.5 | 9.5 | 2 | 2 | 12 |
| Initial Diameter | 305 | 305 | 194 | 304 | 304 | 304 |
| Discard Diameter | 280 | 280 | 180 | 280 | 280 | 280 |
| Diameter of Intermediate Layer | 272 | 272 | 171 | 265 | 265 | 272 |
| Thickness at Discard Diameter[1] | 16 | 16 | 14 | 12.5 | 12.5 | 16 |

[1]Thickness from the roll surface to a boundary between the intermediate layer and the inner layer at the discard diameter.

Test pieces were cut out from the end portions of the outer, intermediate and inner layers of each composite cemented carbide roll, and the composition analysis of binder phases, the observation of structures, and the measurement of thermal shrinkage ratios between 650° C. and 500° C., compressive yield strength, bending strength and residual stress were conducted.

(a) Composition Analysis of Binder Phases and Observation of Structures

The composition analysis results of the binder phases are shown in Table 13. In the observation of structures, composite carbides having equivalent circle diameters of 5 μm or more were not observed in the cemented carbides forming the outer and intermediate layers in Examples 1-4, and Comparative Examples 1 and 2. The total amounts of bainite phases and martensite phases in the binder phases in the cemented carbides forming the outer and intermediate layers in all Samples were 50% or more by area, except for the intermediate layer of Comparative Example 2, which was 100% composed of an austenite phase.

TABLE 13

| Composition of Binder Phase (% by mass)[1] | | Ex. 1 | Ex. 2 | Ex. 3 | Ex. 4 | Com. Ex. 1 | Com. Ex. 2 |
|---|---|---|---|---|---|---|---|
| Outer Layer | Si | 0.91 | 0.93 | 0.92 | 0.91 | 0.93 | 0.9 |
| | Ni | 4.92 | 4.89 | 4.93 | 4.97 | 5.05 | 4.89 |
| | Cr | 0.89 | 0.9 | 0.94 | 0.89 | 0.91 | 0.94 |
| | W | 1.63 | 1.61 | 1.59 | 1.64 | 1.6 | 1.63 |
| | C | 0.81 | 0.81 | 0.83 | 0.79 | 0.82 | 0.76 |
| | Fe[2] | Bal. | Bal. | Bal. | Bal. | Bal. | Bal. |
| Intermediate Layer | Si | 0.91 | 0.93 | 0.92 | 0.92 | 0.89 | 0 |
| | Ni | 4.92 | 4.98 | 4.96 | 4.88 | 5.01 | 50 |
| | Cr | 0.89 | 0.92 | 0.94 | 0.91 | 0.93 | 0 |
| | W | 1.6 | 1.63 | 1.58 | 1.64 | 1.64 | 1.61 |
| | C | 0.81 | 0.83 | 0.76 | 0.78 | 0.76 | 0.8 |
| | Fe[2] | Bal. | Bal. | Bal. | Bal. | Bal. | Bal. |

[1]Analyzed values.
[2]The balance includes inevitable impurities.

(b) Thermal Shrinkage Rate Between 650° C. and 500° C.

Using a thermal dilatometer, the thermal shrinkage of each test piece heated to 650° C. or higher was measured in a cooling process from 650° C. to 500° C. to determine an average shrinkage rate between 650° C. and 500° C. The measurement results of thermal shrinkage rate between 650° C. and 500° C., thermal shrinkage rate differences between the intermediate layer and the outer layer, and thermal shrinkage rate differences between the inner layer and the intermediate layer are shown in Table 14.

TABLE 14

| Thermal Shrinkage Rate[1] | Ex. 1 | Ex. 2 | Ex. 3 | Ex. 4 | Com. Ex. 1 | Com. Ex. 2 |
|---|---|---|---|---|---|---|
| Outer Layer | 6.90 | 6.90 | 9.05 | 9.05 | 6.90 | 6.90 |
| Intermediate Layer | 11.64 | 11.64 | 11.64 | 13.80 | 13.80 | 15.84 |
| Inner Layer | 14.66 | 14.66 | 14.66 | 14.66 | 14.66 | 14.66 |
| Intermediate – Outer Difference[2] | 4.74 | 4.74 | 2.59 | 4.75 | 6.90 | 8.94 |

TABLE 14-continued

| Thermal Shrinkage Rate[1] | Ex. 1 | Ex. 2 | Ex. 3 | Ex. 4 | Com. Ex. 1 | Com. Ex. 2 |
|---|---|---|---|---|---|---|
| Inner – Intermediate Difference[3] | 3.02 | 3.02 | 3.02 | 0.86 | 0.86 | −1.18 |

[1]Thermal shrinkage rate ($\times 10^{-6}$/° C.) between 650° C. and 500° C.
[2]Thermal shrinkage rate difference ($\times 10^{-6}$/° C.) between the intermediate layer and the outer layer.
[3]Thermal shrinkage rate difference ($\times 10^{-6}$/° C.) between the inner layer and the intermediate layer.

(c) Compressive Yield Strength, Bending Strength and Residual Stress

The results are shown in Tables 15 and 16. Incidentally, the residual stress was measured in a circumferential direction of the composite roll by a destructive method using a strain gauge.

TABLE 15

| Layer | Strength (MPa) | Ex. 1 | Ex. 2 | Ex. 3 | Ex. 4 | Com. Ex. 1 | Com. Ex. 2 |
|---|---|---|---|---|---|---|---|
| Outer | CYS[1] | 1400 | 1400 | 1500 | 1500 | 1600 | 1600 |
| Layer | BS[2] | 2190 | 2190 | 2325 | 2325 | 2280 | 2280 |
| Intermediate | CYS[1] | 1500 | 1500 | 1500 | —[3] | —[3] | 1000 |
| Layer | BS[2] | 2430 | 2652 | 2590 | — | — | 2050 |

[1]Compressive yield strength.
[2]Bending strength.
[3]Not measurable because the intermediate layer was too thin.

TABLE 16

| Residual Stress (MPa) | Ex. 1 | Ex. 2 | Ex. 3 | Ex. 4 | Com. Ex 1 | Com. Ex. 2 |
|---|---|---|---|---|---|---|
| Outer Layer Surface | −360 | −282 | −456 | −355 | −320 | −410.5 |
| Outer-Intermediate Boundary[1] | −105 | −82 | −86 | 111 | 244 | 252.7 |
| Intermediate-Inner Boundary[2] | −120 | −94 | −108 | 112 | 247 | 271.9 |

[1]Boundary between the outer layer and the intermediate layer.
[2]Boundary between the intermediate layer and the inner layer.

A peripheral surface of the outer layer was ground by a diamond grinder. The details of the grinder used and the surface roughness Ra of the peripheral surface are shown in Table 17.

TABLE 17

| Layer | Ex. 1 | Ex. 2 | Ex. 3 | Ex. 4 | Com. Ex. 1 | Com. Ex. 2 |
|---|---|---|---|---|---|---|
| Type of Grinder | SD120N 100M | SD120N 100M | SD170N 100M | SD170N 100M | SD170N 100B | SD170N 100M |
| Surface Roughness Ra (μm) | 0.8 μm | 1.0 μm | 0.6 μm | 0.58 μm | 0.12 μm | 0.64 μm |

The above results indicate that in Comparative Example 1 having a ratio c2/c1 of 44%, failing to meet the condition of $0.45 \leq c2/c1 \leq 0.85$, wherein c1 represents the amount (parts by mass) of WC particles in the outer layer, and c2 represents the amount (parts by mass) of WC particles in the intermediate layer, there is large thermal shrinkage rate difference between the outer layer and the intermediate layer, subjecting the intermediate layer to residual tensile stress, likely causing failure between the outer layer and the intermediate layer. Also, in Comparative Example 2, whose intermediate layer contains as much as 50% by mass of Ni and has a structure composed of 100% austenite, the compressive yield strength is as low as 1000 MPa, and the intermediate layer has a larger thermal shrinkage rate than that of the outer layer, resulting in high residual tensile stress in the intermediate layer, likely causing failure in a boundary between the outer layer and the intermediate layer.

On the other hand, the composite cemented carbide rolls of Examples 1-4 are less likely broken by fatigue even under repeated high load during rolling. This is because the roll is configured such that the peak of shear stress generated by rolling at a position several millimeters below the rolling surface is not located in a portion subjected to high residual tensile stress. If a shear peak by rolling stress were repeatedly applied to a roll portion subjected to residual tensile stress, it would likely be broken by fatigue. To avoid such breakage, it is effective to design the roll structure, such that the outer layer having residual compressive stress to the depth of several millimeters from the roll surface or the intermediate layer not subjected to high tensile stress despite extremely low residual tensile or compressive stress expands inside a rolling-stress-receiving range as deep as several millimeters from the roll surface, to avoid high residual tensile stress from being applied to the outer and intermediate layers, thereby preventing the residual tensile stress from being superimposed to the shearing stress.

To prevent breakage occurring from the intermediate layer, it is effective to make the thermal shrinkage difference between the intermediate layer and the outer layer smaller, thereby avoiding high tensile stress from remaining. It is also necessary that the outer layer or the intermediate layer has sufficient thickness even at the discard diameter at which the outer layer is thinnest, such that inner layer having high residual tensile stress is several millimeters or more inside the rolling surface. Thermal shrinkage difference is small in any of Examples 1-4, because the amount c2 of WC particles in the intermediate layer is 0.45 or more times the amount c1 of WC particles in the outer layer. Further, 50% or more in total by area of bainite phases and/or martensite phases in the binder phases of the outer and intermediate layers generate such transformation expansion as to make the thermal shrinkage of the intermediate layer closer to that of the outer layer, thereby preventing the generation of high residual tensile stress. In any Example, a sufficient total thickness of the remaining outer and intermediate layers is secured at the discard diameter, such that the thickness from the roll surface to a boundary between the intermediate layer and the inner layer is 8 mm or more, and that a peak of shearing stress by rolling does not exist in the inner layer even at the discard diameter.

What is claimed is:

1. A composite cemented carbide roll comprising an inner layer made of steel, an outer layer made of cemented carbide, and an intermediate layer made of cemented carbide which is metallurgically bonded to said inner layer and said outer layer;

the cemented carbide forming said outer layer comprising 55-90 parts by mass of WC particles, and 10-45 parts by mass of a binder phase comprising Fe as a main component, the binder phase of said outer layer having a chemical composition comprising 0.5-10% by mass of Ni, 0.2-2.0% by mass of C, 0.5-5% by mass of Cr, and 0.1-5% by mass of W, the balance being Fe and inevitable impurities;

the cemented carbide forming said intermediate layer comprising 30-65 parts by mass of WC particles, and 35-70 parts by mass of a binder phase comprising Fe as a main component, the binder phase of said intermediate layer having a chemical composition comprising 0.5-10% by mass of Ni, 0.2-2.0% by mass of C, 0.5-5% by mass of Cr, and 0.1-5% by mass of W, the balance being Fe and inevitable impurities; and the amount c1 (parts by mass) of WC particles in said outer layer and the amount c2 (parts by mass) of WC particles in said intermediate layer meeting $0.45 \leq c2/c1 \leq 0.85$.

2. The composite cemented carbide roll according to claim 1, wherein the cemented carbides of said intermediate layer and said outer layer contain substantially no composite carbides having equivalent circle diameters of 5 μm or more.

3. The composite cemented carbide roll according to claim 1, wherein said WC particles contained in said intermediate layer and said outer layer have a median diameter D50 of 0.5-10 μm.

4. The composite cemented carbide roll according to claim 1, wherein the binder phases in said intermediate layer and said outer layer further contain 0.2-2.0% by mass of Si, 0-5% by mass of Co, and 0-1% by mass of Mn.

5. The composite cemented carbide roll according to claim 1, wherein the amount of bainite phases and/or martensite phases in the binder phases in said intermediate layer and said outer layer is 50% or more by area in total.

6. The composite cemented carbide roll according to claim 1, wherein said outer layer is as thick as 5-40 mm, and said intermediate layer is as thick as 3-15 mm, at the initial diameter.

7. The composite cemented carbide roll according to claim 1, wherein said composite cemented carbide roll is as thick as 8 mm or more from the surface to a boundary between said intermediate layer and said inner layer, at the discard diameter.

* * * * *